US006851147B2

(12) United States Patent
Abrahall

(10) Patent No.: US 6,851,147 B2
(45) Date of Patent: Feb. 8, 2005

(54) COMBINATION MONEY CLIP AND BOTTLE CAP OPENER AND METHOD FOR FORMATION

(76) Inventor: Ronald C. Abrahall, 141 13th Ave., Holtsville, NY (US) 11742

( * ) Notice: Subject to any disclaimer, the term of this patent is extended or adjusted under 35 U.S.C. 154(b) by 0 days.

(21) Appl. No.: 10/688,284

(22) Filed: Oct. 17, 2003

(65) Prior Publication Data

US 2004/0083552 A1 May 6, 2004

Related U.S. Application Data

(60) Provisional application No. 60/422,672, filed on Oct. 31, 2002.

(51) Int. Cl.[7] ..... B67B 7/16

(52) U.S. Cl. ..... 7/151; 81/3.09; 81/3.55

(58) Field of Search ..... 7/151; 81/3.07, 81/3.09, 3.55

(56) References Cited

U.S. PATENT DOCUMENTS

| | | | | | |
|---|---|---|---|---|---|
| 1,267,052 | A | | 5/1918 | Burnett | |
| D144,839 | S | | 5/1946 | Coles | |
| D171,311 | S | | 1/1954 | Schaefer | |
| D193,477 | S | * | 8/1962 | Britton | D11/78.1 |
| 4,625,861 | A | * | 12/1986 | Krog | 206/234 |
| 4,642,827 | A | * | 2/1987 | Karuzas | 7/151 |
| 4,923,392 | A | * | 5/1990 | Moynihan, III | 431/253 |
| D409,464 | S | | 5/1999 | Garza | |
| D461,427 | S | * | 8/2002 | Braner | D11/78.1 |
| D473,437 | S | * | 4/2003 | Klein et al. | D8/34 |

* cited by examiner

*Primary Examiner*—David B. Thomas

(57) ABSTRACT

A combination money clip and bottle cap opener is provided.

15 Claims, 6 Drawing Sheets

COMBINATION MONEY CLIP AND BOTTLE CAP OPENER AND METHOD FOR FORMATION

CROSS-REFERENCE TO RELATED APPLICATION

The present application claims the benefit of U.S. Provisional Application No. 60/422,672 entitled "Money Clip and Bottle Cap Opener" and filed Oct. 31, 2002, the contents of which are hereby incorporated by reference in their entirety for all purposes. The present application further claims the benefit of U.S. Disclosure Document No. 518142 filed on Sep. 11, 2002, the contents of which are incorporated by reference in their entirety for all purposes.

FIELD

The present invention relates to money clips and holders. More particularly, embodiments relate to combination money clips and bottle cap openers.

BACKGROUND

People carry many different items. For example, people generally carry a wallet or money clip. Many people also carry a pocket knife or key chain having a bottle cap opener. It would be desirable to reduce the number of items people need to carry.

Others have developed combination money clips and bottle openers. For example, one combination is shown in U.S. Pat. No. D409,464, issued to Garza on May 11, 1999. The Garza combination uses a loop-shaped cap opener formed on one end of a money clip. The interior of the loop-shape includes a projection or tab that, in use, is inserted beneath a cap to pry it off a bottle. Unfortunately, because the loop is fairly large (wider than the width of a typical bottle cap), a user's finger can be caught in it, particularly when reaching into a pocket. Further, it can snag on other items such as clothing, keys, or the like. Similar designs, having similar deficiencies, are shown in U.S. Pat. Nos. 1,267,052, and 4,923,392 issued on May 21, 1918 and May 8, 1990, respectively.

Other combination money clips and bottle openers have been developed. For example, U.S. Pat. Nos. D144,839 and D171,311, issued May 28, 1946 and Jan. 19, 1954, respectively, show combinations which provide a cap opener formed on one end of a money clip. Unfortunately, the designs suffer in that they provide a narrow surface as a base from which to pry a cap off. This can, in some situations, make it difficult to open a bottle. Further, because the designs are formed on an end of the clip, they can snag on other items or cause injury when reaching into a pocket.

It would be desirable to provide an improved combination money clip and bottle cap opener.

SUMMARY

To alleviate these problems, embodiments of the present invention introduce a combination money clip and bottle cap opener. Pursuant to some embodiments, a combination money clip and bottle cap opener includes a clip body extending to a bend portion, a clip arm extending back along the clip body from the bend portion, the clip arm having a spring clip biased against the clip body. The bend portion defines a cap aperture shaped to receive a bottle cap.

Pursuant to some embodiments, a method for forming a combination money clip and cap opener is provided which includes providing a sheet of material having a long axis and a shorter axis perpendicular to the long axis, forming a cutout along the shorter axis, the cutout having a substantially symmetrical shape about the shorter axis, and bending the sheet of material along the shorter axis to form a clip having a body portion and an arm portion, the arm portion formed to press against the body portion, the cutout defining a cap aperture having a lifting portion and an anchor portion.

Pursuant to some embodiments, a clip formed from a single sheet of material is provided, which includes a clip body extending to a bend portion, a clip arm extending from the bend portion back along the clip portion, a biasing means causing the clip arm to press against the clip body, and a cap aperture, formed in the bend portion and shaped to receive a bottle cap, the cap aperture having a lifting portion and an anchor portion.

DETAILED DESCRIPTION

The following description is provided to enable a person of ordinary skill in the art to make and use embodiments of the claimed invention and sets forth the best modes contemplated by the inventor for carrying out the claimed invention. Various modifications, however, will remain readily apparent to those in the art.

Figure 1:
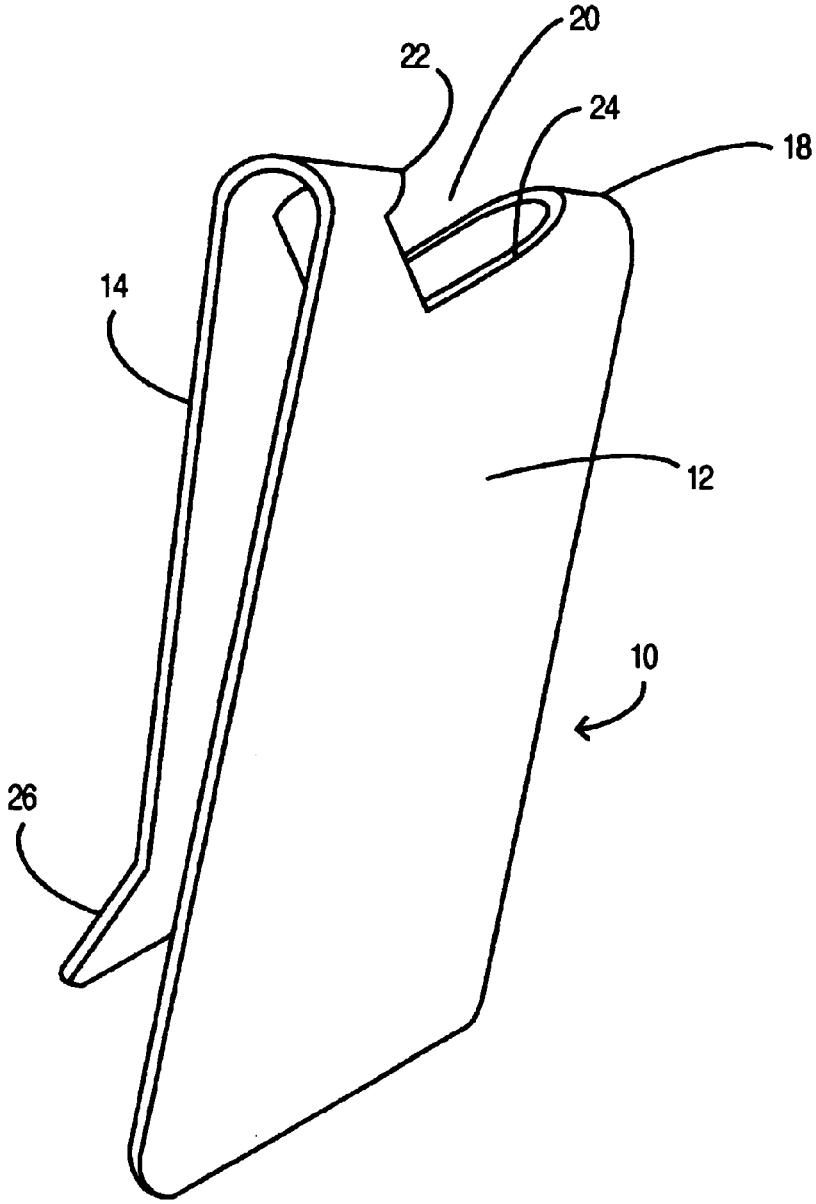
FIG. 1 is a perspective view of a money clip and bottle cap opener according to some embodiments.

Embodiments of the present invention relate to devices that include both a money clip and a cap opener formed in a single device. Features of some embodiments will now be described by reference to the drawings. Referring first to FIG. 1, a perspective view of a money clip and cap opener 10 pursuant to some embodiments is shown. Money clip and cap opener 10 includes a clip body 12 extending to a bend portion 18 and a clip arm 14 extending back along clip body 12 from bend portion 18. Clip arm 14 includes a spring clip 26 formed to bias against clip body 12. In use, an object or objects (such as currency, credit cards, documents, generally referred to herein as "money", etc.) are inserted between clip arm 14 and clip body 12. Spring clip 26 acts to hold the object or objects between clip arm 14 and clip body 12. Those skilled in the art will appreciate that other types of clips and biasing mechanisms may also be used to hold an object or objects between clip arm 14 and clip body 12.

Money clip and cap opener 10 further includes a cap aperture 20 formed substantially along bend portion 18. Cap aperture 20 and bend portion 18 define a lifting portion 22 and an anchor portion 24. In general, cap aperture 20 is shaped and sized to receive a bottle cap. For example, cap aperture 20 may be formed such that lifting portion 22 and anchor portion 24 are spaced apart a distance slightly greater than the height of a typical bottle cap, allowing a bottle cap to be positioned between lifting portion 22 and anchor portion 24. The shape and configuration of aperture 20 is, in some embodiments, selected to reduce the chance of injury or snagging. For example, lifting portion may be formed as a tab or projection that is unlikely to cause injury or snag on items.

Embodiments provide an improved ability to open bottles as compared to some previous devices. In part, this improved ability results from the formation of cap aperture 20 on bend portion 18 such that anchor portion 24 includes two anchor surfaces (one provided by the exposed edge of clip body 12 and one provide by the exposed edge of clip arm 14), thereby providing a stable surface against which to place a bottle cap when opening a bottle. Further, for similar reasons, lifting portion 22 is provided with increased strength and stability for lifting caps.

Figure 2:
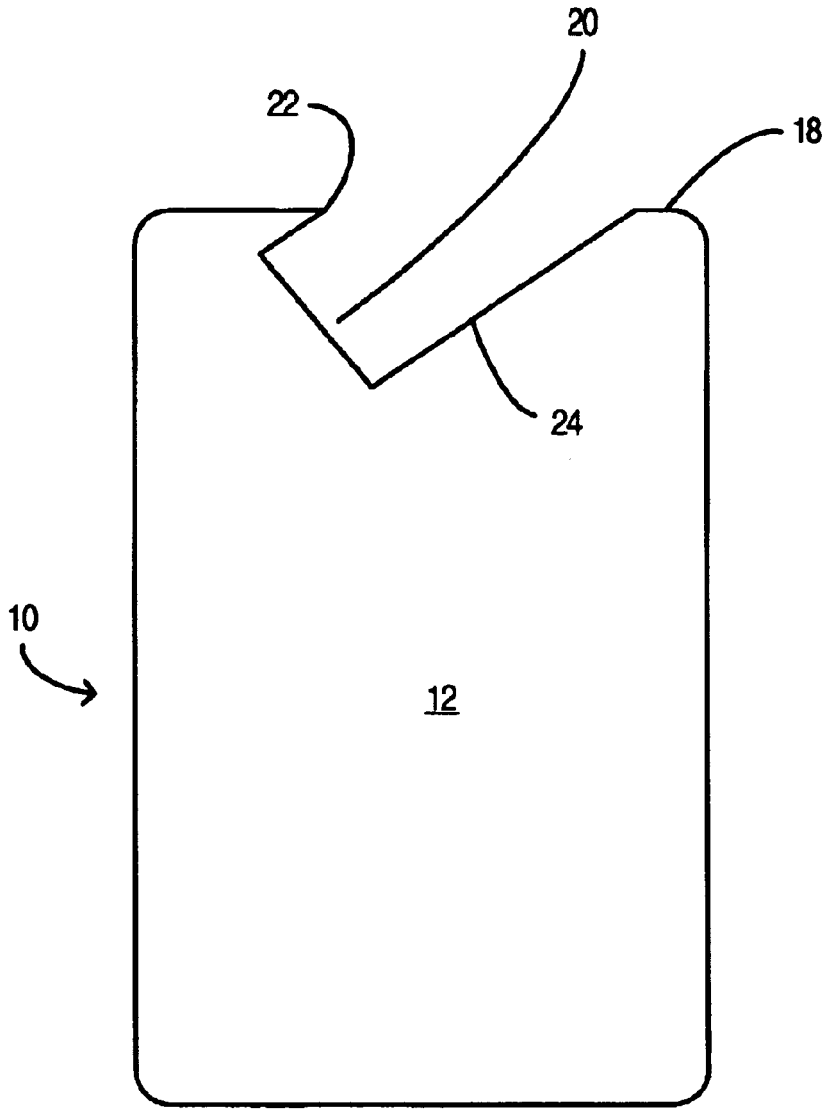
FIG. 2 is a plan view of the money clip and cap opener of FIG. 1.

Referring now to FIG. 2, a top plan view of money clip and cap opener 10 is shown. In some embodiments, as shown, money clip and cap opener 10 may be formed as a substantially rectangular piece. Applicant has found that a shape in which clip body 12 is longer than bend portion 18 provides desirable results by providing a user with sufficient leverage to easily open bottle caps, providing a good surface against which to clip items such as money, and providing an overall shape which easily fits in a user's pocket. Further, as will be discussed further below, a substantially rectangular shape provides manufacturing advantages as well. Those skilled in the art, however, upon reading this disclosure, will recognize that other shapes and configurations may be used.

Figure 3:
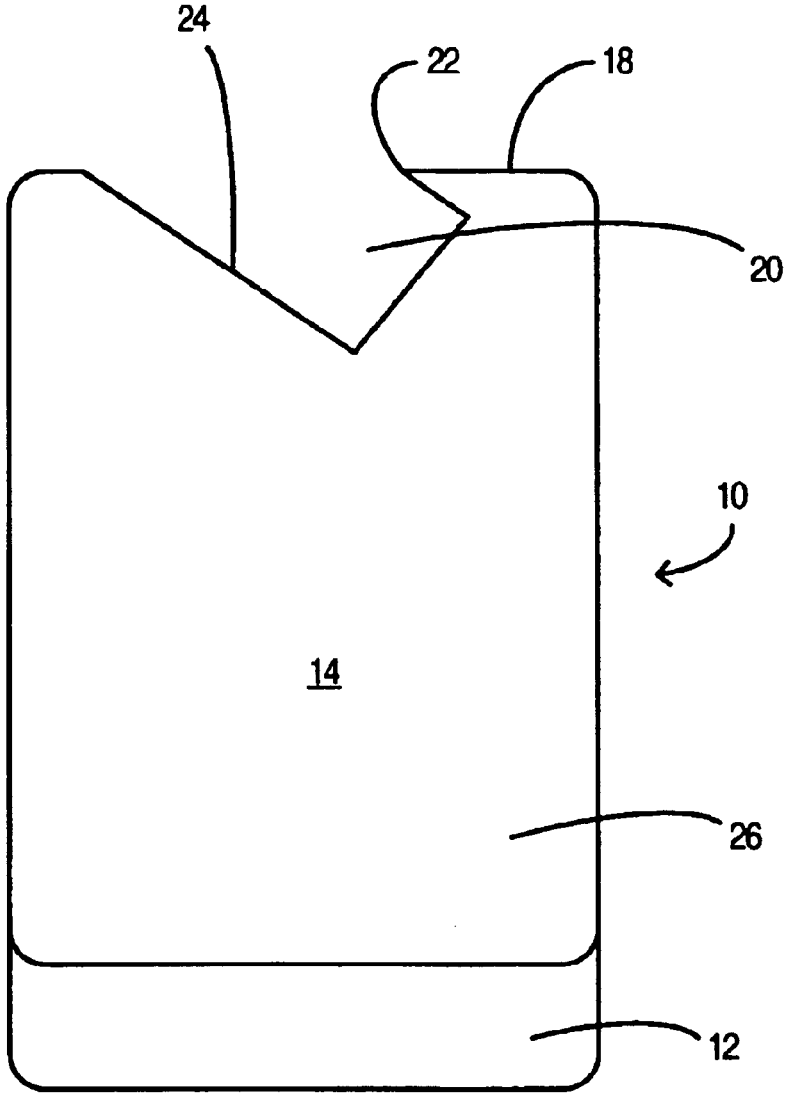
FIG. 3 is a plan view of the money clip and cap opener of FIG. 1.

Reference is now made to FIG. 3, where a bottom plan view of money clip and cap opener 10 is shown. In some embodiments, as shown, clip arm 14 is formed to be shorter than body portion 12, thereby allowing objects (such as currency, credit cards, identification, other documents, etc.) to be more easily inserted between clip arm 14 and body portion 12.

Figure 4:
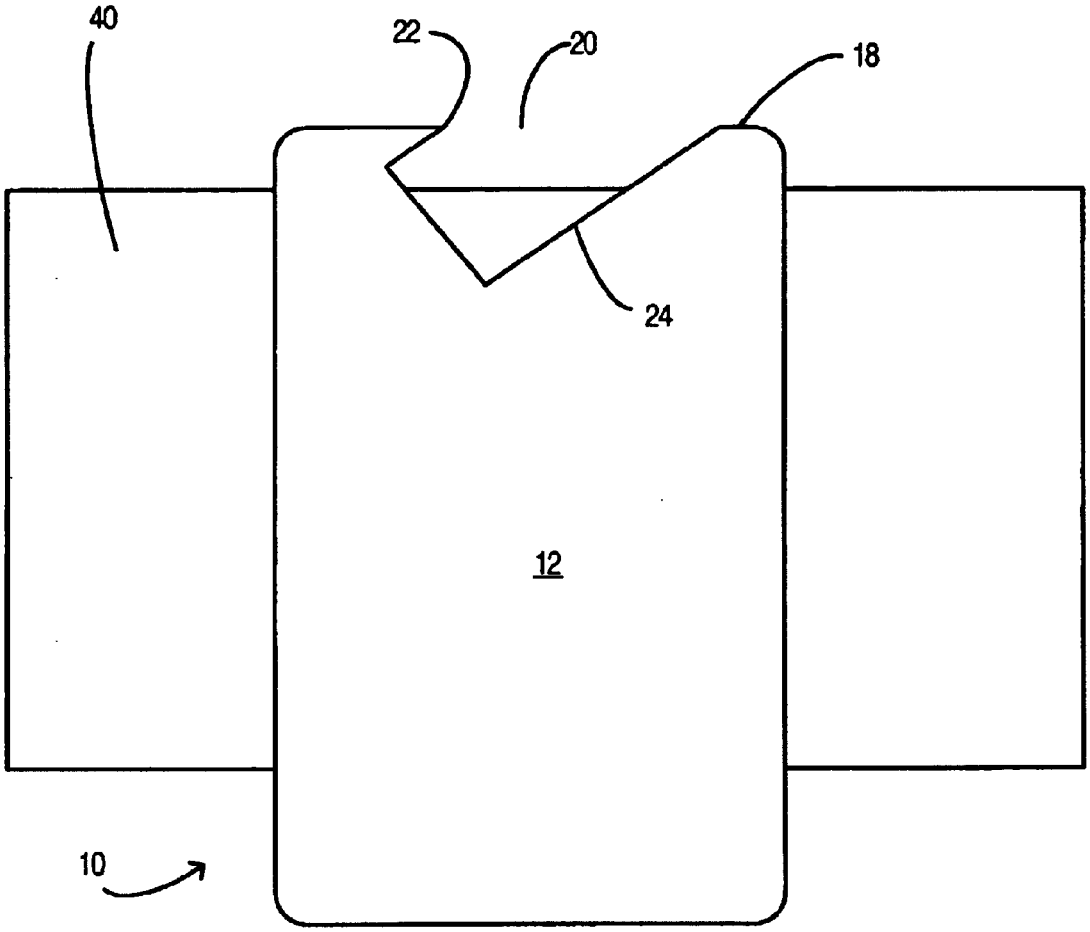
FIG. 4 is a plan view of the money clip and cap opener of FIG. 1 illustrating use of the device as a money holder.

Referring now to FIG. 4, a plan view is shown where money 40 is inserted between clip arm 14 and body portion 12. In use, the money inserted between clip arm 14 and body portion 12 may be pushed all the way against bend portion 18 to cover cap aperture 20 to further reduce the possibility of snagging or injury. When a user wishes to use the device as a cap opener, the money need not be removed; instead, the money can either be slid away from the bend portion or may even remain in place. In general, portion of money clip and cap opener 10 that acts as a cap opener does not interfere with the use of the device as a clip. Further, as shown in FIG. 5, the portion of money clip and cap opener 10 that acts as a clip does not interfere with use of the device as a cap opener.

Figure 5:
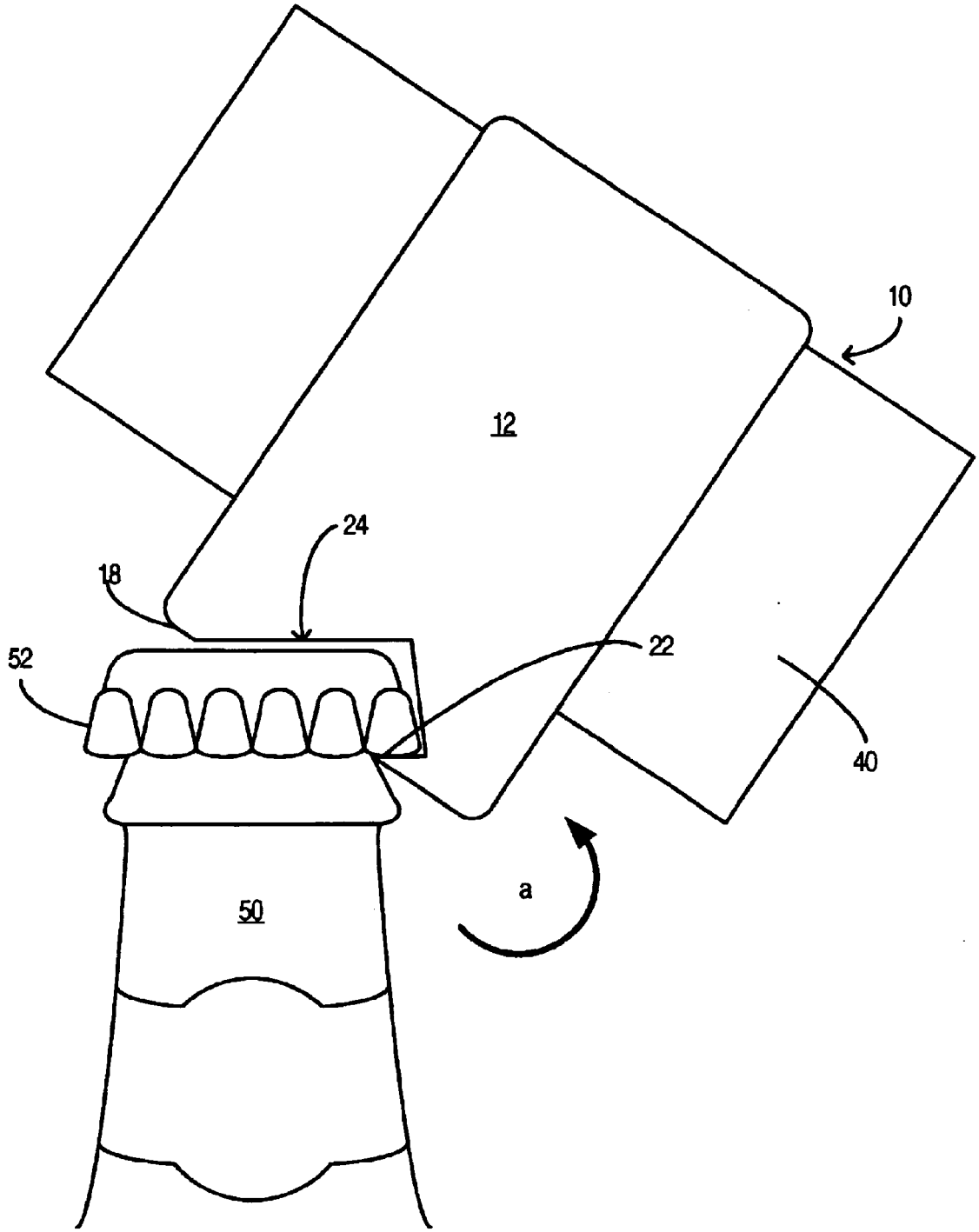
FIG. 5 is a plan view of the money clip and cap opener of FIG. 1 illustrating use of the device as a cap opener.

FIG. 5 depicts use of money clip and cap holder 10 to open a bottle 50 having a bottle cap 52. A typical bottle cap 52 includes a bottom lip or edge. Embodiments allow any of a number of different types of caps to be opened, including caps commonly referred to as "crown-type" bottle caps similar to the cap shown in FIG. 5. Lifting portion 22 of money clip and cap opener 10 is formed to fit beneath the bottom lip or edge of bottle cap 52. Anchor portion 24 of money clip and cap opener 10 is formed to rest, at least partially, on a top surface of bottle cap 52. In use, the user rotates money clip and cap opener 10 (e.g., about rotation axis "a") to lift bottle cap 52 using lifting portion 22. Because lifting portion 22 and anchor portion 24 are formed from the bend portion 18 of the device, each is formed from the juncture of two edges, providing additional lifting strength and anchor stability which was unavailable in some previous devices. Again, as depicted in FIG. 5, embodiments allow bottles to be opened using the cap opener portion while the money clip portion continues to hold money.

Figure 6:
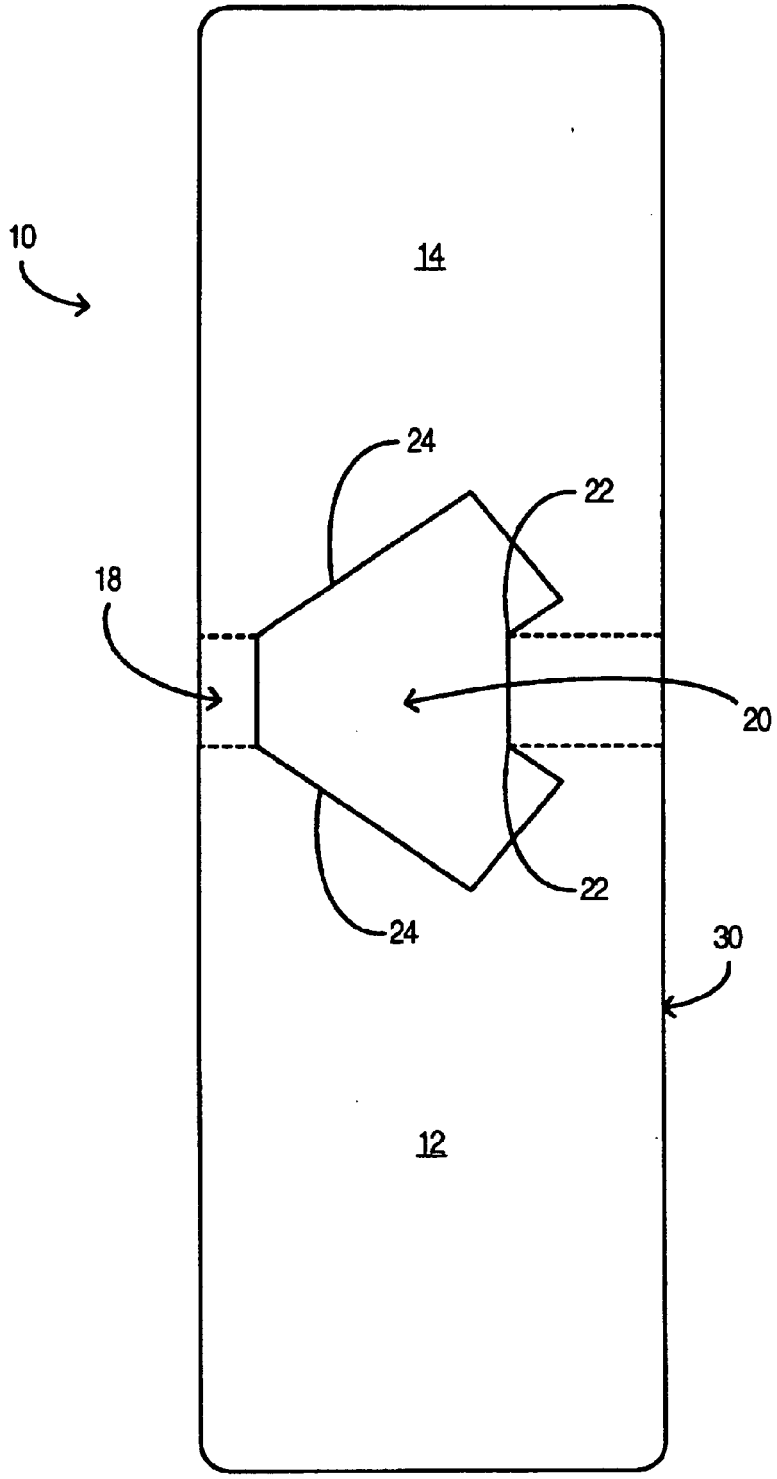
FIG. 6 is a plan view of a sheet in the formation of the money clip and cap opener of FIG. 1.

Reference is now made to FIG. 6 where a plan view is shown depicting the formation of a money clip and cap opener pursuant to some embodiments. In the embodiment shown, the money clip and cap opener is formed from a sheet 30 of rigid material, such as a metal. As shown, sheet 30 is substantially rectangular in shape, having a long axis defining clip arm 14 and clip body 12. Sheet 30 also has a shorter axis, perpendicular to the long axis, along which the sheet is bent (e.g., at the region identified as bend portion 18).

Prior to bending the sheet, in some embodiments, a shape defining cap aperture 20 is stamped or cut into the sheet 30. As shown, the shape of cap aperture 20 is substantially symmetrical about the short axis. In this manner, when the sheet is bent at bend portion 18, cap aperture 20 is formed in a manner that allows the aperture to receive a bottle cap as described above. Applicant has discovered that manufacturing money clip and cap opener 10 in this fashion provides a number of advantages, including low cost and efficient manufacture. Further, by forming the cap opener portion as an aperture in a sheet of rigid material, the device 10 does not have protrusions that may catch or snag on a pocket or the like. A number of different types of materials may be used for sheet 30. In some embodiments, sheet 30 is a sheet of metal. Although a number of different types and thicknesses of metal sheet may be used, in some embodiments, sheet 30 is formed from a steel having a thickness of approximately 0.025–0.05". Other materials may also be used, and other thicknesses. In some embodiments, some or all of the clip is formed from a plastic or other rigid material. In some embodiments, cap aperture 20, lifting portion 22 and anchor portion 24 may be formed from a metal insert held in a plastic body. Those skilled in the art will appreciate that other configurations may also be used.

The several embodiments described herein are solely for the purpose of illustration. Embodiments may include any currently or hereafter-known versions of the elements described herein. Further, although the embodiments are briefly described for clarity, those skilled in the art will understand how to make any changes, if necessary, to the above-described apparatus and methods to accommodate these and other embodiments and applications.

Those skilled in the art will appreciate that other uses may be made of the combination money clip and bottle cap opener. For example, while embodiments have been described using the term "money clip", the clip portion of the present invention may be used to hold other items (e.g., such as credit cards, other papers, etc.). As another example, the clip may be formed for further use as a belt clip (e.g., and incorporated into other design items, such as a beeper holder, cell phone holder, etc.). Further, while embodiments have been described using the term "bottle cap", the opener portion of the present invention may be used to perform other functions as well (e.g., to open cans, etc.). Use of an aperture formed in a bend portion of the clip provides improved strength and stability, allowing a wide variety of different items to be opened or pried.

Further, although lifting portion 22 has been illustrated as having a relatively straight point, other configurations may also be used. For example, lifting portion 22 may be formed with a flat or pointed projection extending to provide improved connection with a bottom surface of a bottle cap. Similarly, while spring clip 26 has been shown as having a shape that is generally rounded or curved, it may also be formed in other shapes, such as a "v" shape, or the like, so long as objects may be readily inserted (and held) between clip arm 14 and clip body 12. Other shapes, surfaces and configurations may also be provided. For example, magnets, tensioning devices, and other devices may be used to hold objects between clip arm 14 and clip body 12.

Further, while a method for forming a combination money clip and bottle cap opener has been described, other techniques may also be used. For example, laser cutting and other cutting techniques may be used to retrofit existing money clips to include cap aperture 20 formed as described herein. Persons skilled in the art will recognize from this description that other embodiments may be practiced with various modifications and alterations.

What is claimed:

1. A combination money clip and bottle cap opener, comprising:

a clip body extending to a bend portion;

a clip arm extending back along said clip body from said bend portion, said clip arm having a spring clip biased against said clip body; and said bend portion defining a cap aperture shaped to receive a bottle cap.

2. The combination money clip and bottle cap opener of claim 1, wherein said bend portion further defines an anchor portion and a lifting portion, said lifting portion shaped to lift a bottle cap.

3. The combination money clip and bottle cap opener of claim 2, wherein said lifting portion includes a pointed projection.

4. The combination money clip and bottle cap opener of claim 2, wherein said lifting portion includes a flat projection.

5. The combination money clip and bottle cap opener of claim 2, wherein said lifting portion includes a tab shaped to fit beneath an edge of a bottle cap.

6. The combination money clip and bottle cap opener of claim 1, wherein said spring clip has at least one of a bow shape and a v-shape.

7. A method for forming a combination money clip and cap opener, comprising:

providing a sheet of material having a long axis and a shorter axis perpendicular to said long axis;

forming a cutout along said shorter axis, said cutout having a substantially symmetrical shape about said shorter axis; and bending said sheet of material along said shorter axis to form a clip having a body portion and an arm portion, said arm portion formed to press against said body portion, said cutout defining a cap aperture having a lifting portion and an anchor portion.

8. The method of claim 7, wherein said material is a rigid material having a thickness of approximately 0.025–0.05".

9. The method of claim 7, wherein said sheet of material has a substantially rectangular shape.

10. The method of claim 7, wherein said lifting portion has at least one of a pointed projection, a flat projection, and a tab projection to fit beneath a bottom of a bottle cap.

11. The method of clain 7, wherein said arm portion includes a spring portion having at least one of a curved shape and a v-shape.

12. A clip formed from a single sheet of material, comprising:

a clip body extending to a bend portion;

a clip arm extending from said bend portion back along said clip portion;

biasing means causing said clip arm to press against said clip body; and a cap aperture, formed in said bend portion and shaped to receive a bottle cap, said cap aperture having a lifting portion and an anchor portion.

13. The clip of claim 12, wherein said sheet of material is substantially elongated in shape.

14. The clip of claim 12, wherein said sheet of material is a rigid sheet of material.

15. The clip of claim 12, wherein said biasing means is at least one of a spring clip and a magnet.

* * * * *